US010167182B2

(12) United States Patent
Moore et al.

(10) Patent No.: US 10,167,182 B2
(45) Date of Patent: Jan. 1, 2019

(54) VACUUM SIDE AIR VENT

(71) Applicant: THE COCA-COLA COMPANY, Atlanta, GA (US)

(72) Inventors: William J. Moore, Lilburn, GA (US); Robert D. Hughes, IV, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 15/307,192

(22) PCT Filed: Apr. 30, 2015

(86) PCT No.: PCT/US2015/028559

§ 371 (c)(1),
(2) Date: Oct. 27, 2016

(87) PCT Pub. No.: WO2016/175839

PCT Pub. Date: Nov. 3, 2016

(65) Prior Publication Data

US 2018/0044161 A1 Feb. 15, 2018

(51) Int. Cl.
*B67D 1/08* (2006.01)
*B67D 1/00* (2006.01)

(52) U.S. Cl.
CPC ..... *B67D 1/0885* (2013.01); *B67D 1/0021* (2013.01); *B67D 1/0882* (2013.01); *B67D 2001/0827* (2013.01)

(58) Field of Classification Search
CPC ..... B67D 1/0885; B67D 1/0021; B67D 2001/0827
USPC ..... 222/481.5
See application file for complete search history.

(56) References Cited

U.S. PATENT DOCUMENTS 4,518,541 A * 5/1985 Harris ..... A23L 2/54 261/27
4,886,525 A * 12/1989 Hoover ..... A23L 2/54 95/26
5,199,609 A * 4/1993 Ash, Jr. ..... B67D 1/0406 141/114
9,249,006 B2 * 2/2016 Tobler ..... F25C 5/182
2005/0056713 A1 * 3/2005 Tisone ..... B01D 19/0047 239/690

* cited by examiner

*Primary Examiner* — Donnell Long

(57) ABSTRACT

A volume of fluid may be received at the air chamber from a fluid source and dispensed to a nozzle. The fluid source may be in fluid communication with the air chamber. The flow may be reversed to draw the fluid to the air chamber and purge air within the air chamber or the fluid to the atmosphere.

17 Claims, 11 Drawing Sheets

VACUUM SIDE AIR VENT

This application is a U.S. National stage application of PCT/US2015/028559, which was filed on Apr. 30, 2015, as a PCT International Patent application, the entire disclosure of which is incorporated by reference in its entirety.

BACKGROUND

Fluid packages may contain a volume of unwanted air or another gas. This unwanted air may be introduced into the package and inadvertently stored in the package along with the fluid. The unwanted air contained in the fluid package may be introduced into a supply line and eventually pass through a pump into a dispensing tower. This is problematic. The formed product, which is typically a beverage, may contain excessive foaming or the quality compromised. In addition, the pump or metering system may malfunction due to excessive pumping of air.

Several advancements have been made to alleviate the unwanted air in the supply line. For example, a reservoir may be positioned along the high-pressure side of the supply line, i.e. after the pump. The reservoir may have an inlet and an outlet and may include a float. The float automatically opens a bleed valve as it falls in the reservoir causing any excess air accumulated in the reservoir to relinquish. The float operates as a mechanical valve. Therefore, where the float failed to close, the reservoir may be susceptible to possible spillage.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

Removing air within an air chamber may be provided. A volume of fluid (e.g., beverage forming ingredients) may be received at the air chamber from a fluid source and dispensed to a nozzle. The fluid source may be in fluid communication with the air chamber. The flow may be reversed to draw the fluid to the air chamber and purge any air within the air chamber or the fluid source to the atmosphere.

These and other features and advantages will be apparent from a reading of the following detailed description and a review of the associated drawings. It is to be understood that both the foregoing general description and the following detailed description are illustrative only and are not restrictive of the disclosed embodiments.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Figure 1:
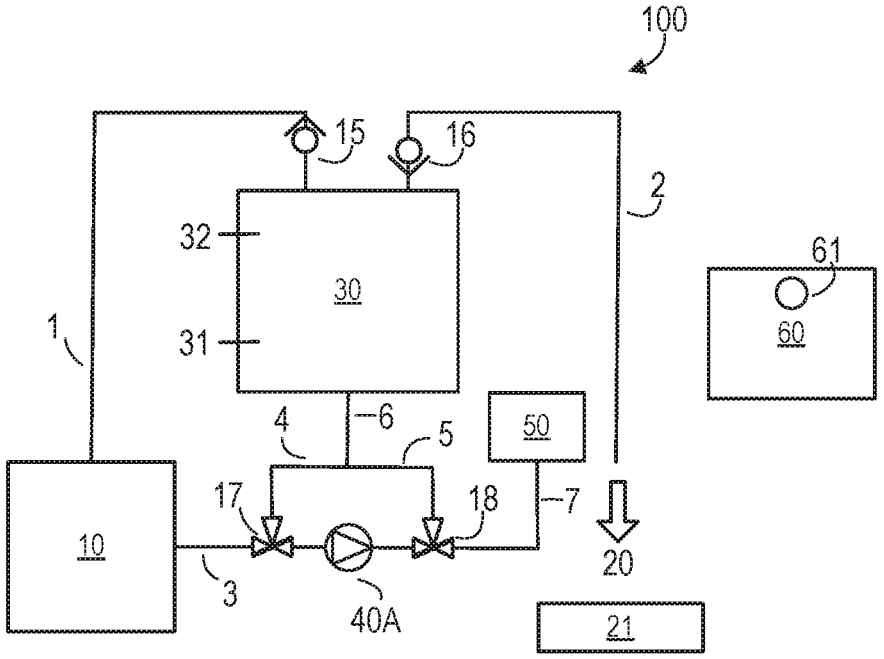
FIG. 1 is a schematic view of a diagram of an exemplary operating environment for eliminating air within an air chamber as is described herein.

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding operations to the disclosed methods. Accordingly, the following detailed description does not limit the disclosure. Instead, the proper scope of the disclosure is defined by the appended claims.

It should be understood that "beverage," as used herein, includes, but is not limited to, pulp and pulp-free citrus and non-citrus fruit juices, fruit drinks, vegetable juice, vegetable drink, milk, soy milk, protein drink, soy-enhanced drink, tea, water, isotonic drink, vitamin-enhanced water, soft drink, flavored water, energy drink, coffee, smoothies, yogurt drinks, hot chocolate and combination thereof. The beverage may also be carbonated or non-carbonated. The beverage may comprise beverage components (e.g., beverage bases, colorants, flavorants, and additives.)

The term "beverage base" refers to parts of the beverage or the beverage itself prior to additional colorants, additional flavorants, and/or additional additives. According to certain embodiments of the present disclosure, beverage bases may include, but are not limited to syrups, concentrates, and the like that may be mixed with a diluent such as still or carbonated water or other diluent to form a beverage. The beverage bases may have reconstitution ratios of about 3:1 to about 6:1 or higher. According to certain embodiments, beverage bases may comprise a mixture of beverage base components.

The term "beverage base component" refers to components, which may be included in beverage bases. According to certain embodiments of the present disclosure, the beverage base component may comprise parts of beverages, which may be considered food items by themselves. According to certain embodiments of the present disclosure, the beverage base components may be micro-ingredients such as an acid portion of a beverage base, an acid-degradable and/or non-acid portion of a beverage base, natural and artificial flavors, flavor additives, natural and artificial flavors, nutritive or non-nutritive natural or artificial sweeteners, additives for controlling tartness (e.g., citric acid or potassium citrate), functional additives such as vitamins, minerals, or herbal extracts, nutraceuticals, or medicaments. The micro-ingredients may have reconstitution ratios from about 10:1, 20:1, 30:1, or higher with many having reconstitution ratios of 50:1 to 300:1. The viscosities of the micro-ingredients may range from about 1 to about 100 centipoise.

Thus, for the purposes of requesting, selecting, or dispensing a beverage base, a beverage base formed from separately stored beverage base components may be equivalent to a separately stored beverage base. For the purposes of requesting, selecting or dispensing a beverage, a beverage formed from separately stored beverage components may be equivalent to a separately stored beverage.

By "separately stored" it is meant that the components of the present disclosure are kept separate until combined. For instance, the components may be separately stored individually in each container or may be all stored in one container wherein each component is individually packaged so that they do not blend while in the container. In some embodiments, the container, itself, may be individual, adjacent to, or attached to another container.

The term "blended beverage" includes final products wherein two or more beverages have been blended or mixed or otherwise combined to form a final product. According to certain embodiments, the present disclosure provides for methods and apparatuses that allow for the dispensing of a variety of beverage bases.

Embodiments are described in detail below and are exemplified in FIGS. 1 and 2. It should be understood that any of the features in embodiments of the methods and apparatuses of the present disclosure described may be used in combination with each other in alternate embodiments.

FIG. 1 is a schematic view of a diagram of an exemplary operating environment 100 for eliminating air within an air chamber. As shown in FIG. 1, the operating environment 100 may comprise a fluid source 10, atmosphere 20, an air chamber 30, a pump 40A, a nozzle 50, an user interface 60, valves, and sensors. The valves may include check valve 15, check valve 16, three-way valve 17, and three-way valve 18.

The fluid source 10 may include, for example, a beverage forming ingredient source that is inserted into an ingredient-housing and/or a beverage forming ingredient source that is remotely situated relative to a dispenser and connected to the ingredient housing via suitable supply lines. See FIG. 12. For example, the fluid source 10 may include a conventional bag-in-box container remote from the dispenser. A bag-in-box container may include a rigid box, often made of cardboard, provided with a flexible bag included within the bag-in-box container. The flexible bag may have a supply tube extending from an upper surface of the bag-in-box container to facilitate removal of the beverage-forming ingredient stored within the flexible bag. As another example, the fluid source 10 may include a micro-ingredient cartridge or carton.

The beverage-forming ingredient may include a macro-ingredient from a macro-ingredient source. The macro-ingredients may include juice concentrates, sugar syrup, HFCS ("High Fructose Corn Syrup"), concentrated extracts, purees, or similar types of ingredients. Other ingredients may include dairy products, soy, and/or rice concentrates. Similarly, a macro-ingredient based product may include the sweetener as well as flavorings, acids, and other common components. The juice concentrates and dairy products generally may require refrigeration. The fluid source 10 may also include a conventional water connection, or any other type of fluid storage, supply, or delivery device. In one embodiment, the fluid source 10 may be inserted into an ingredient housing. The fluid source 10 may be in communication with the atmosphere 20, the air chamber 30, the pump 40A, and the nozzle 50.

Also illustrated in FIG. 1 is a nozzle 50. The nozzle 50 may mix and dispense the beverage-forming ingredients into a cup. The mixing of the beverage-forming ingredients may occur prior to, during, and/or following the dispense of the flows from the nozzle 50.

The beverage-forming ingredient may include a micro-ingredient from a micro-ingredient source. The micro-ingredients may have a dilution or a reconstitution ratio ranging from about ten to one (10:1), twenty to one (20:1), thirty to one (30:1), or higher. Specifically, many micro-ingredients may be in the range of fifty to one (50:1) to three hundred to one (300:1) or higher. The viscosities of the micro-ingredients typically range from about 1 to about 100 centipoise or so. Examples of micro-ingredients include natural and artificial flavors; flavor additives; natural and artificial colors; artificial sweeteners (high potency or otherwise); additives for controlling tartness, e.g., citric acid, potassium citrate; functional additives such as vitamins, minerals, herbal extracts; nutraceuticals; and over-the-counter (or otherwise) medicines such as acetaminophen and similar types of materials. The acid and non-acid components of the non-sweetened concentrate may be separated and stored individually. The micro-ingredients may be liquid, powder (solid), or gaseous form and/or combinations thereof. The micro-ingredients may or may not require refrigeration. Non-beverage substances such as paints, dyes, oils, cosmetics, etc., also may be used. Various types of alcohols may be used as micro or macro-ingredients.

Generally, the pump 40A may pump the fluid from the fluid source 10 to the nozzle 50 in a dispensing operation. The fluid may be pumped from the fluid source 10 to the air chamber 30 via the check valve 15 and line 1. The fluids may be pumped from the air chamber 30 to the pump 40A via the line 6, line 4, and the three-way valve 17. In other words, the three-way valve 17 may receive fluid from the air chamber 30 via line 4 and supply the fluid to the pump 40A.

While fluid is being pumped from the air chamber 30, the check valve 16 prevents air from being drawn into the air chamber 30 from the atmosphere 20. The fluids may be pumped to the nozzle 50 via the three-way valve 18 and line 7. In other words, the three-way valve 18 may receive fluid from the pump 40A and supply the fluid to the nozzle 50 via line 7.

As fluid is drawn from the bottom of the air chamber 30 and dispensed via the nozzle 50, fluid from the fluid source 10 may also be drawn into the top of the air chamber 30. However, the volume of fluid drawn into the top of the air chamber 30 may be less than the volume of fluid dispensed from the bottom of the air chamber 30 to the nozzle 50. That is, the volume of fluid contained in the air chamber 30 after dispensing a beverage may be less than the volume of fluid contained in the air chamber 30 before dispensing the beverage. Therefore, the air chamber 30 may not be refilled completely after dispensing a beverage.

For example, air may be introduced and inadvertently stored in the fluid source 10 along with the fluid. The air contained in the fluid source 10 may be introduced into line 1 and eventually pass through the check valve 15 into the air chamber 30. The air introduced into air chamber 30 may take up some of the storage volume within the air chamber 30, thereby leaving less fluid in the air chamber 30.

Because of the introduction of air into the air chamber 30, the air chamber 30 may be periodically vented in a venting operation in order to minimize or avoid pumping air downstream of the air chamber 30. As described in more detail below, the venting operation may be triggered subsequent to dispensing a beverage, subsequent to dispensing a predetermined number of beverages, after a first predetermined amount of time, based on triggers from level sensing probes 31, 32 and/or other predetermined bases.

The air chamber 30 may be vented in the venting operation and refilled with fluids by reversing the flow of fluid into the air chamber 30. Specifically, the three-way valve 17 may be switched so as to receive fluid from the fluid source 10 via line 3 and supply the fluid to the pump 40A. Moreover, the three-way valve 18 may be switched to receive fluid from the pump 40A and to direct the fluid to the air chamber 30 via line 5 and away from the nozzle 50. Therefore, rather than receiving fluid from the top of the air chamber 30 as is done while dispensing a beverage, the air chamber 30 may receive fluid from the bottom of the air chamber 30. While fluid is being pumped into the bottom of the air chamber 30, the check valve 15 may prevent air from being pumped back into the fluid source 10. Also, as the pumped fluid displaces the air in the air chamber 30, the air may be vented via the check valve 16 to the atmosphere. Any beverage forming ingredients or other fluids pumped to the atmosphere 20 by the pump 40A may be collected in drain 21.

The air chamber 30 may be vented when a user provides an indication to do so. A user indication may include the user navigating to a home menu, inactivity of the user, or any other suggestions the user is finished dispensing a beverage. For example, after a user stops dispensing a beverage via a touch input 61 on user interface 60, such as by pressing a stop button or releasing a pour button, and does not interact with the user interface 60 for a specified duration of time, the air chamber 30 may be vented. The specified duration of time may include one, two, five, ten, or more seconds. Furthermore, the air chamber 30 may be vented between dispenses, after every other dispense, or any other combination of a predetermined number of dispenses. For example, after every two dispenses, the air chamber 30 may be vented.

The air chamber 30 may include level probes 31 and 32. The level probes may include electrical conductive sensors, bubble detection sensors, phase sensors, or any other known types of sensors configured to determine the volume of beverage forming ingredients and/or unwanted air within the air chamber 30. The high probe 32 and low probe 31 may also detect the state of the unwanted air within the air chamber 30 and activate venting the air chamber 30. For example, the air chamber 30 may be vented upon the low probe 31 detecting air. The low probe 31 may be positioned such that, if the low probe 31 detects air during a dispensing operation, there is sufficient volume of fluid in the air chamber 30 to complete the dispensing operation prior to venting the air chamber 30. For example, there may be a sufficient volume of fluid in the air chamber 30 below the low probe to dispense the largest available beverage from the dispenser, the average beverage size dispensed from the dispenser, or some other predetermined size of beverage.

The air chamber 30 may continue to be vented until the high probe 32 detects the beverage forming ingredients. Alternatively, the air chamber 30 may continue to be vented for a first predetermined amount of time. As a further alternative, the air chamber 30 may continue to be vented for the first predetermined amount of time, unless the high probe 32 detects the beverage forming ingredients. That is, the high probe 32 ensures that the air chamber 30 is not overfilled while it is being vented for the first predetermined amount of time. The first predetermined amount of time may be about one, two, five, or ten seconds or more. For example, the air chamber 30 may be vented for seven seconds unless the high probe 32 detects the beverage ingredients.

Figure 2:
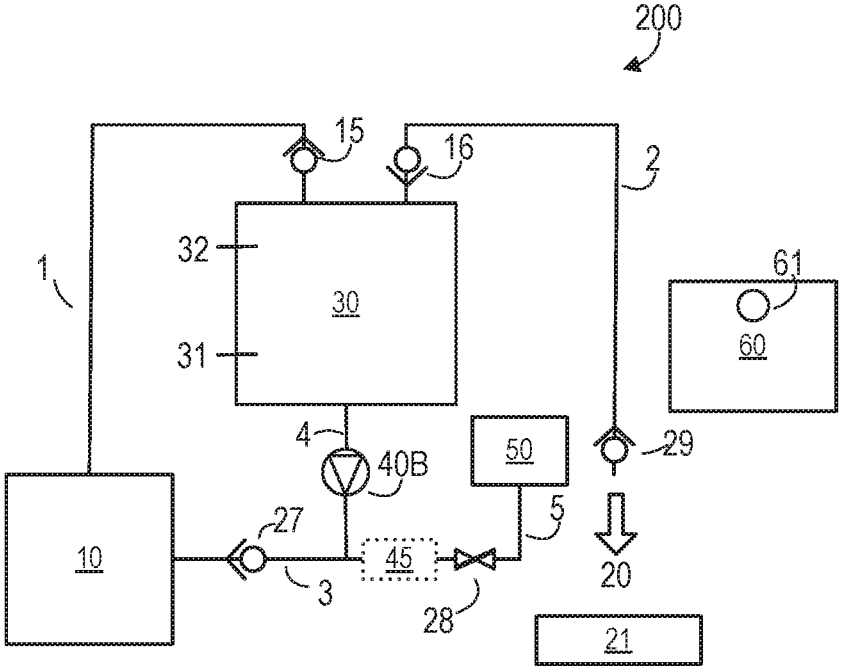
FIG. 2 is an alternative schematic view of a diagram of an exemplary operating environment for eliminating air within an air chamber as is described herein.

FIG. 2 is a schematic diagram of an alternative exemplary operating environment 200 for dispensing fluids via the air chamber 30 and venting the air chamber 30. The same reference numbers are used in FIG. 2 to refer to the same or similar elements described above in conjunction with FIG. 1. Moreover, the operating environment 200 may be operated similar to the operating environment 100 as described above with respect to triggering venting of the air chamber. Accordingly, a duplicate description of those operations using operating environment 200 is hereby omitted, but fully contemplated by this disclosure.

As shown in FIG. 2, the operating environment 200 may comprise a reversible pump 40B and an optional heat exchanger 45. The reversible pump 40B may include a conventional metered pump, positive displacement pump, metering pump, syringe pump, rotary pump, peristaltic pump, nutating pump, gear pump, and/or other types of fluid moving device capable of generating both a forward flow of fluid and a reverse flow of fluid. The reversible pump 40B may also include a variable speed motor, enabling the reversible pump 40B to generate variable fluid flow.

The valves may include check valve 15, check valve 16, check valve 27, a shut-off valve 28, and check valve 29. The shut-off valve 28 may be a solenoid valve or any other valve that may be controlled to be opened and closed. In some embodiments, the alternative operating environment 200 may include the heat exchanger 45 upstream from the nozzle 50 for cooling or heating the fluids prior to being dispensed by the nozzle 50. The heat exchanger 45 may include a double pipe heat exchanger, a shell and tube heat exchanger or any device configured to heat or cool the fluid passing through en route to the nozzle 50.

The fluid source 10 may be in fluid communication with the air chamber 30, the reversible pump 40B, and the nozzle 50. Generally, the reversible pump 40B may pump the fluid from the fluid source 10 to the nozzle 50 in a dispensing operation. The fluid may be pumped from the fluid source 10 to the top of the air chamber 30 via the check valve 15 and line 1. The fluids may be drawn from the bottom of the air chamber 30 by the reversible pump 40B via the line 4. The check valve 27 may prevent pumping the fluids that are drawn from the bottom of the air chamber 30 back into the fluid source 10. Moreover, the check valve 16 may prevent air from being drawn into the air chamber 30 from the atmosphere 20 as fluids are drawn from the bottom of the air chamber 30. The fluids may be pumped from the reversible pump 40B to the nozzle 50 via the heat exchanger 45, shut-off valve 28, and line 5. During the dispensing operation, the shut-off valve 18 is open. As described above, during the dispensing operation, air contained in the fluid source 10 may be introduced into the air chamber 30. Therefore, the air chamber 30 may need to be vented occasionally.

Generally, the reversible pump 40B may pump the fluid from the fluid source 10 to the air chamber 30 in a venting operation. The reversible pump 40B may be reversed to refill the fluid within the air chamber 30 and to pump any air within the air chamber 30 to the atmosphere 20. Whereas the reversible pump 40 may pump fluids away from the air chamber 30 during the dispensing operation, the reversible pump 40 may be reversed to pump fluids toward the air chamber 30 during the venting operation.

The reversible pump 40B may draw fluids from the fluid source 10 via the check valve 27 and line 3. The reversible pump 40B may discharge the fluids into the bottom of the air chamber 30 via line 4. While fluids are pumped into the air chamber 30, the check valve 15 may prevent air from being pumped back into the fluid source 10. Moreover, the shut-off valve 28 may be closed so as to prevent drawing in air through the nozzle 50. As fluids displace the air in the air chamber 30, the air may be vented via the check valve 16 and optionally via the secondary check valve 29 to atmosphere 20. Any fluid pumped to the atmosphere 20 by the reversible pump 40B may be collected in drain 21.

Figure 3:
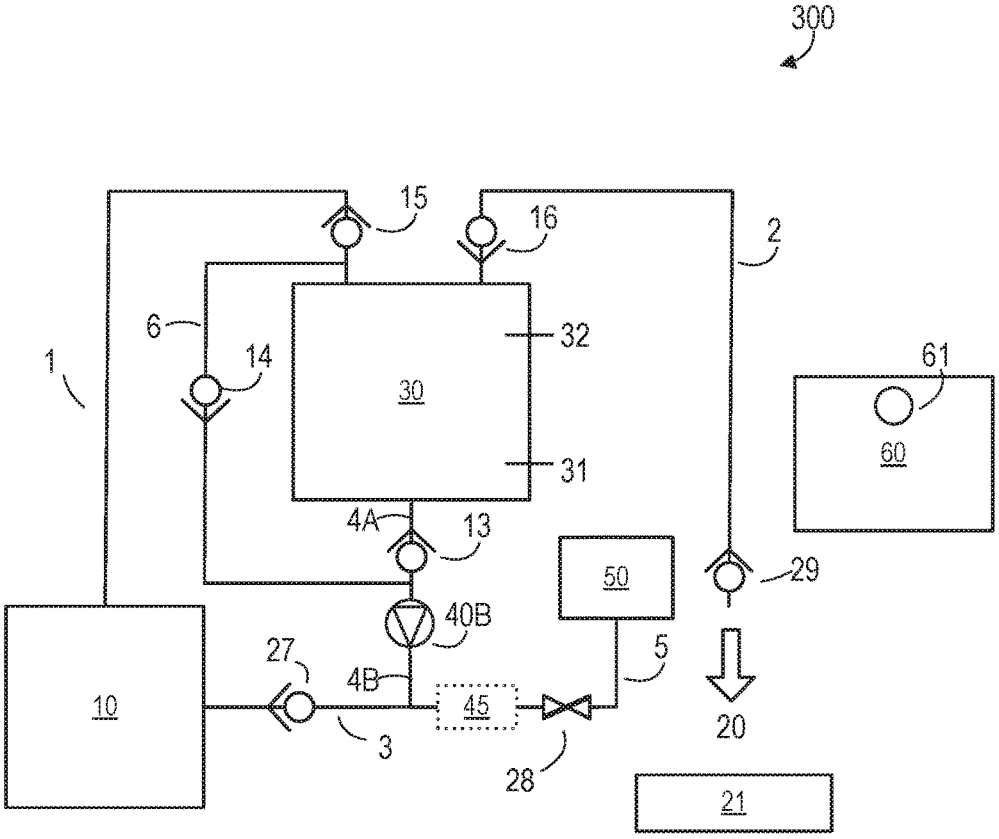
FIG. 3 is an alternative schematic view of a diagram of an exemplary operating environment for eliminating air within an air chamber as is described herein.

FIG. 3 is a schematic diagram of an alternative exemplary operating environment 300 for dispensing fluids via the air chamber 30 and venting the air chamber 30. The same reference numbers are used in FIG. 3 to refer to the same or similar elements described above in conjunction with FIGS. 1 and 2. Moreover, the operating environment 300 may be operated similar to the operating environment 100 as described above with respect to triggering venting of the air chamber. Accordingly, a duplicate description of those operations using operating environment 300 is hereby omitted, but fully contemplated by this disclosure.

As shown in FIG. 3, the operating environment 300 may comprise a check valve 13, a check valve 14, the check valve 15, the check valve 16, the check valve 27, the shut-off valve 28, and the check valve 29. The operating environment 300 is largely similar to the operating environment 200, but with additional valves to enable refilling the air chamber 30 from the top as opposed to refilling the air chamber 30 from the bottom.

The fluid source 10 may be in communication with the air chamber 30, reversible pump 40B, and the nozzle 50. Generally, the reversible pump 40B may pump the fluid from the fluid source 10 to the nozzle 50 in a dispensing operation. The fluid may be pumped from the fluid source 10 to the top of the air chamber 30 via the check valve 15 and line 1. The fluids may be drawn from the bottom of the air chamber 30 by the reversible pump 40B via the line 4A and check valve 13. The check valve 14 may prevent bypassing the air chamber 30 during the dispensing operation. That is, check valve 14 may prevent fluids from being drawn from the top of the air chamber 30 via line 6 prior to the ingredients passing through the air chamber 30. The check valve 27 may prevent pumping the fluids that are drawn from the bottom of the air chamber 30 back into the fluid source 10. Moreover, the check valve 16 may prevent air from being drawn into the air chamber 30 from the atmosphere 20 as fluids are drawn from the bottom of the air chamber 30. The fluids may be pumped from the reversible pump 40B to the nozzle 50 via the heat exchanger 45, shut-off valve 28, and line 5. During the dispensing operation, the shut-off valve 28 is open. As described above, during the dispensing operation, air contained in the fluid source 10 may be introduced into the air chamber 30. Therefore, the air chamber 30 may need to be vented occasionally.

Generally, the reversible pump 40B may pump the fluid from the fluid source 10 to the air chamber 30 in a venting operation. The reversible pump 40B may be reversed to refill the fluid within the air chamber 30 via the top of the air chamber and to pump any air within the air chamber 30 to the atmosphere 20. Whereas the reversible pump 40 may pump fluids away from the air chamber 30 during the dispensing operation, the reversible pump 40 may be reversed to pump fluids toward the air chamber 30 during the venting operation. The reversible pump 40B may draw fluids from the fluid source 10 via the check valve 27 and lines 3 and 4B. The reversible pump 40B may discharge the fluids into the top of the air chamber 30 via check valve 14 and line 6. While fluids are pumped into the air chamber 30, the check valve 13 prevents the air chamber 30 from being refilled from the bottom of the air chamber 30. Therefore, any air contained in the fluid source 10 does not need to pass through the fluids stored in the air chamber 30.

While fluids are pumped into the air chamber 30, the check valve 15 may prevent air from being pumped back into the fluid source 10. Moreover, the shut-off valve 28 may be closed so as to prevent drawing in air through the nozzle 50. As fluids displace the air in the air chamber 30, the air may be vented via the check valve 16 and optionally via the secondary check valve 29 to atmosphere 20. Any fluid pumped to the atmosphere 20 by the reversible pump 40B may be collected in drain 21.

Figure 4:
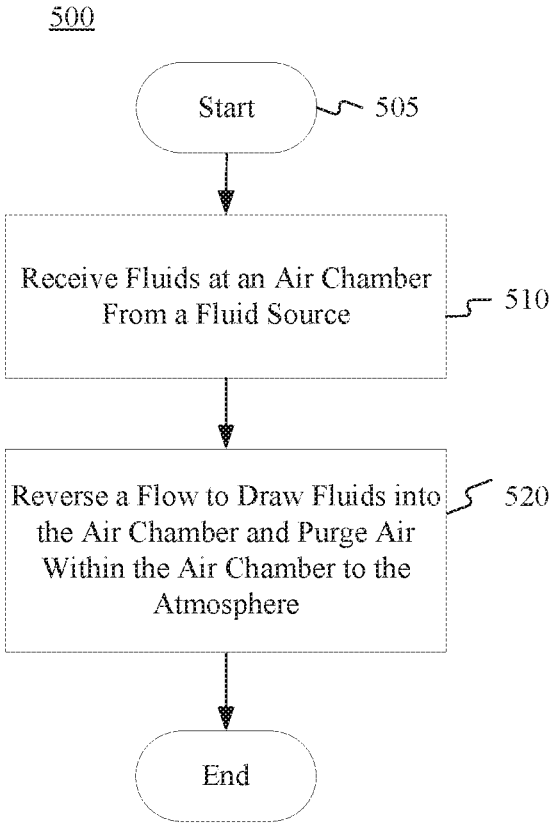
FIG. 4 is a flow chart of a method for removing air within an air chamber as is described herein.

FIG. 4 is a flow chart setting forth the general operations involved in a method 500 consistent with an embodiment of the disclosure for eliminating air within an air chamber. Method 500 may be implemented using the operating environment 100 as described in more detail above with respect to FIG. 1. Ways to implement the operations of method 500 will be described in greater detail below.

Method 500 may begin at starting operation 505 and proceed to operation 510, where a fluid may be received by, for example, the pump 40A. The pump 40A may pump the fluid from the fluid source 10 to the nozzle 50 in a dispensing operation. The fluid may be pumped from the fluid source 10 to the air chamber 30 via the check valve 15 and line 1. The fluids may be pumped from the air chamber 30 to the pump 40A via the line 6, line 4, and the three-way valve 17. In other words, the three-way valve 17 may receive fluid from the air chamber 30 via line 4 and supply the fluid to the pump 40A. While fluid is being pumped from the air chamber 30, the check valve 16 prevents air from being drawn into the air chamber 30 from the atmosphere 20. The fluids may be pumped to the nozzle 50 via the three-way valve 18 and line 7. In other words, the three-way valve 18 may receive fluid from the pump and supply the fluid to the nozzle 50 via line 8.

As fluid is drawn from the bottom of the air chamber 30 and dispensed via the nozzle 50, fluid from the fluid source 10 may also be drawn into the top of the air chamber 30. However, the volume of fluid drawn into the top of the air chamber 30 may be less than the volume of fluid dispensed from the bottom of the air chamber 30 to the nozzle 50. That is, the volume of fluid contained in the air chamber 30 after dispensing a beverage may be less than the volume of fluid contained in the air chamber 30 before dispensing the beverage. Therefore, the air chamber 30 may not be refilled completely after dispensing a beverage. For example, air may be introduced and inadvertently stored in the fluid source 10 along with the fluid. The air contained in the fluid source 10 may be introduced into line 1 and eventually pass through the check valve 15 into the air chamber 30. The air introduced into air chamber 30 may take up some of the storage volume within the air chamber 30, thereby leaving less fluid in the air chamber 30.

From operation 510, where a fluid may be received, method 500 may advance to operation 520 where the flow may be reversed to pump fluids into the air chamber 30 and purge any air within the air chamber 30 to the atmosphere 20. Because of the introduction of air into the air chamber 30, the air chamber 30 may be periodically vented in a venting operation in order to avoid pumping any air downstream of the air chamber 30. As described, the venting operation may be triggered (automatically and/or manually) subsequent to dispensing a beverage, subsequent to dispensing a predetermined number of beverages, after a first predetermined amount of time, based on triggers from level sensing probes 31, 32 and/or other predetermined basis.

The air chamber 30 may be vented in the venting operation and refilled with fluids by reversing the flow of fluid into the air chamber 30. Specifically, the three-way valve 17 may be switched so as to receive fluid from the fluid source 10 via line 3 and supply the fluid to the pump 40A. Moreover, the three-way valve 18 may be switched to receive fluid from the pump 40A and to direct the fluid to the air chamber 30 via line 5 and away from the nozzle 50. Therefore, rather than receiving fluid from the top of the air chamber 30 as is done while dispensing a beverage, the air chamber 30 may receive fluid from the bottom of the air chamber 30. While fluid is being pumped into the bottom on the air chamber 30, the check valve 15 may prevent air from being pumped back into the fluid source 10. Also, as the pumped fluid displaces the air in the air chamber 30, the air may be vented via the check valve 16 to the atmosphere. Any beverage forming ingredients or other fluids pumped to the atmosphere 20 by the pump 40A may be collected in drain 21.

Figure 5:
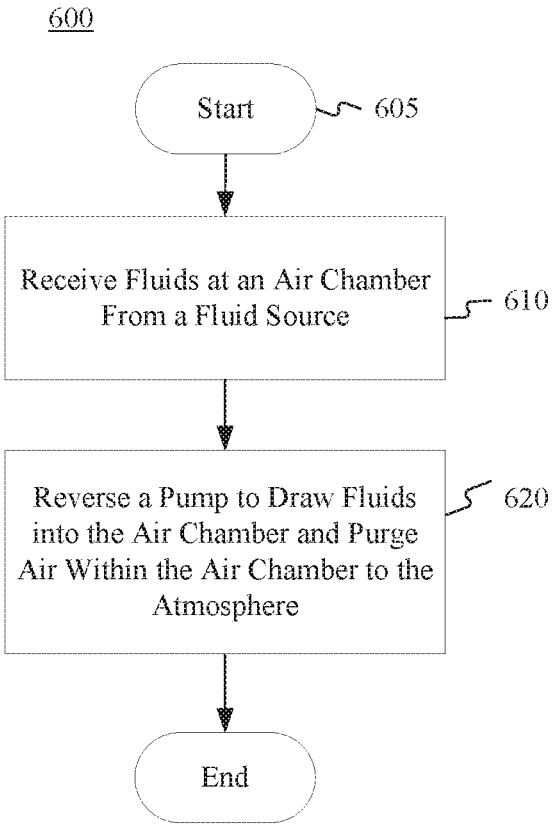
FIG. 5 is a flow chart of an alternative method for removing air within an air chamber as is described herein.

FIG. 5 is a flow chart setting forth the general operations involved in an alternative method 600 consistent with an embodiment of the disclosure for eliminating air within an air chamber. Method 600 may be implemented using one or both of the operating environments 200, 300 as described in more detail above with respect to FIGS. 2 and 3. Ways to implement the operations of method 600 will be described in greater detail below.

Method 600 may begin at starting operation 605 and proceed to operation 610 where a fluid may be received by, for example, the reversible pump 40B. The reversible pump 40B may pump the fluid from the fluid source 10 to the nozzle 50 in a dispensing operation. The fluid may be pumped from the fluid source 10 to the top of the air chamber 30 via the check valve 15 and line 1. The fluids may be drawn from the bottom of the air chamber 30 by the reversible pump 40B via the line 4. The check valve 27 may prevent pumping the fluids that are drawn from the bottom of the air chamber 30 back into the fluid source 10. Moreover, the check valve 16 may prevent air from being drawn into the air chamber 30 from the atmosphere 20 as fluids are drawn from the bottom of the air chamber 30. The fluids may be pumped from the reversible pump 40B to the nozzle 50 via the heat exchanger 45, shut-off valve 28, and line 5. During the dispensing operation, the shut-off valve 18 is open.

In some embodiments, the alternative operating environment 200 may include the heat exchanger 45 upstream from the nozzle 50 for cooling or heating the fluids prior to being dispensed by the nozzle 50. The heat exchanger 45 may include a double pipe heat exchanger, a shell and tube heat exchanger or any device configured to heat or cool the fluid passing through en route to the nozzle 50.

From operation 610, method 600 may advance to operation 620, where the reversible pump may be reversed to refill the fluid within the air chamber 30 and to pump any air within the air chamber 30 to the atmosphere 20. During the dispensing operation, air contained in the fluid source 10 may be introduced into the air chamber 30. Therefore, the air chamber 30 may need to be vented occasionally. The reversible pump 40B may pump the fluid from the fluid source 10 to the air chamber 30 in a venting operation.

The reversible pump 40B may be reversed to refill the fluid within the air chamber 30 and to pump any air within the air chamber 30 to the atmosphere 20. Whereas the reversible pump 40 may pump fluids away from the air chamber 30 during the dispensing operation, the reversible pump 40 may be reversed to pump fluids toward the air chamber 30 during the venting operation.

The reversible pump 40B may draw fluids from the fluid source 10 via the check valve 17 and line 3. The reversible pump 40B may discharge the fluids into the bottom of the air chamber 30 via line 4. While fluids are pumped into the air chamber 30, the check valve 15 may prevent air from being pumped back into the fluid source 10. Moreover, the shut-off valve 28 may be closed so as to prevent drawing in air through the nozzle 50. As fluids displace the air in the air chamber 30, the air may be vented via the check valve 16 and optionally via the secondary check valve 29 to atmosphere 20. Any fluid pumped to the atmosphere 20 by the reversible pump 40B may be collected in drain 21.

Figure 6:
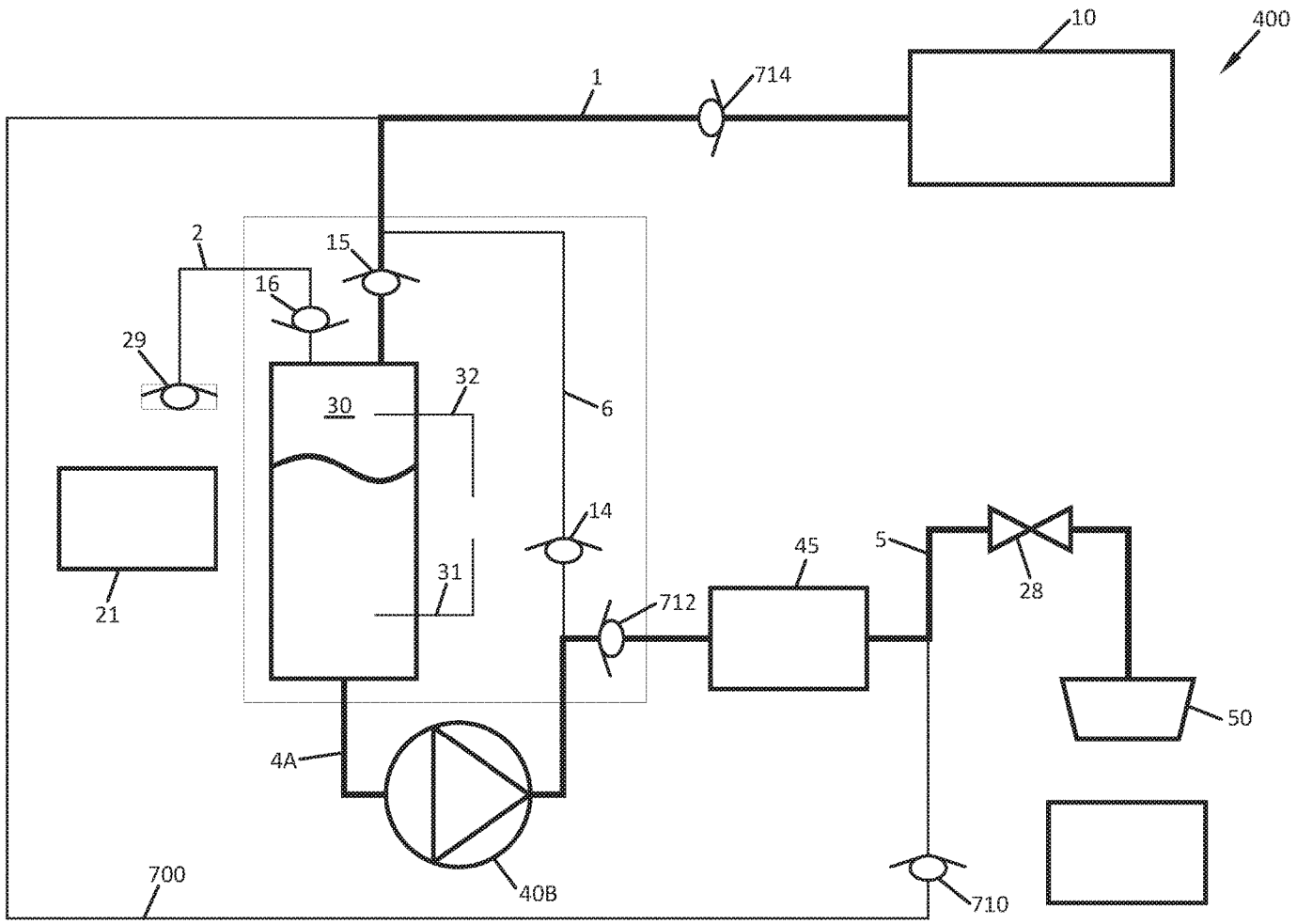
FIG. 6 is an alternative schematic view of a diagram of an exemplary operating environment for eliminating air within an air chamber as is described herein.
Figure 7:
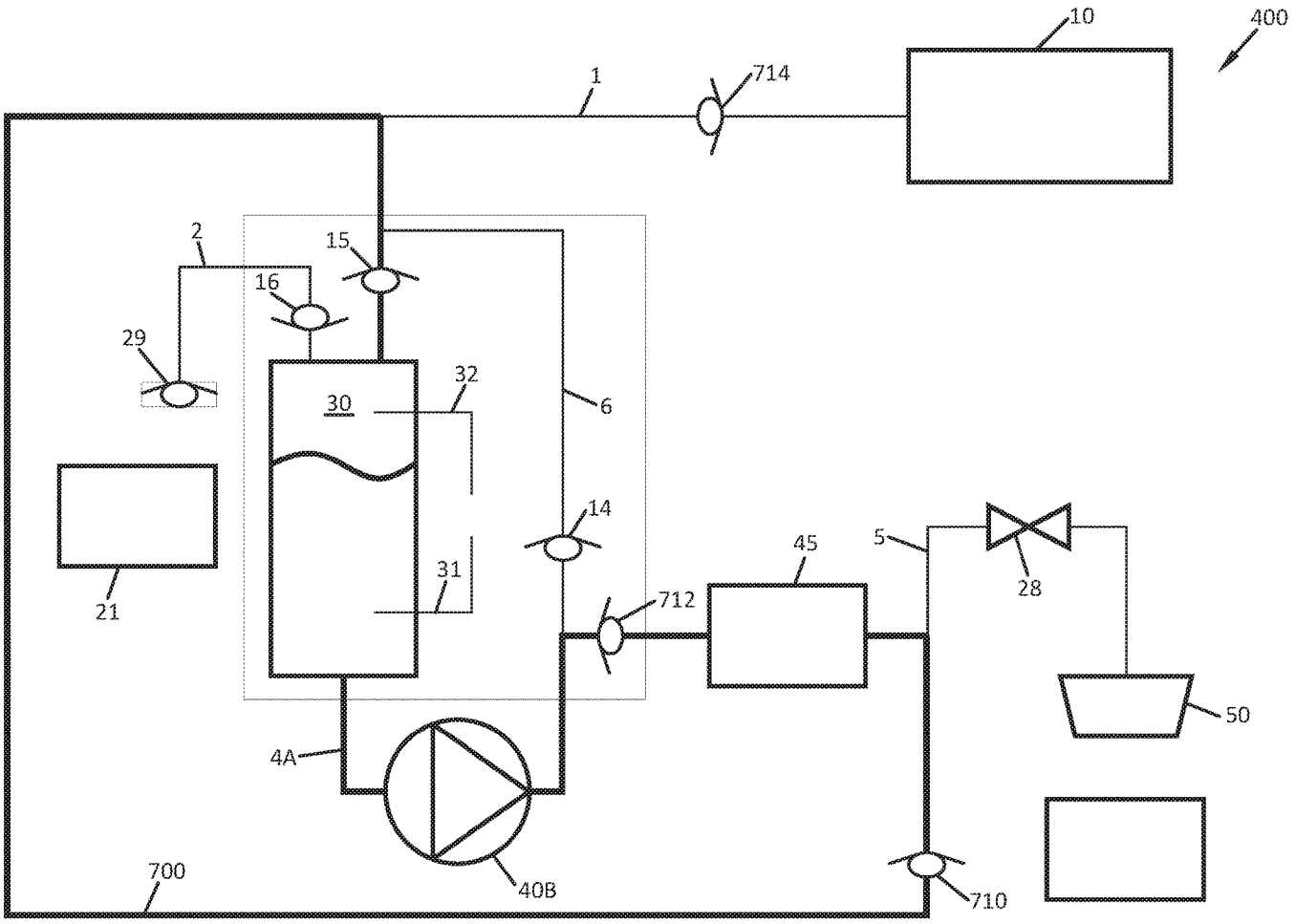
FIG. 7 is another view of the operating environment of FIG. 6.
Figure 8:
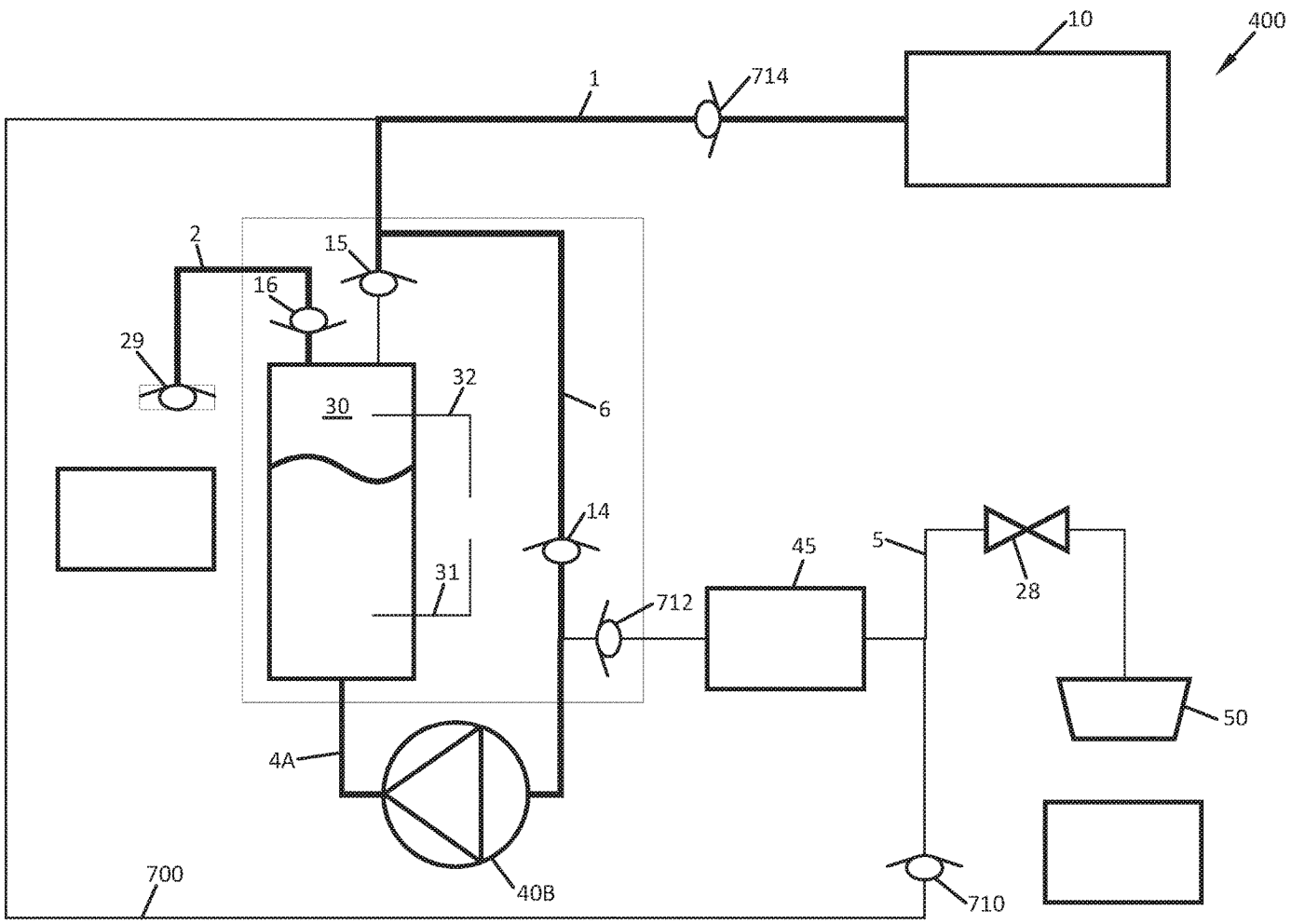
FIG. 8 is another view of the operating environment of FIG. 6.

Referring now to FIGS. 6-8, another example operating environment 400 is shown. The operating environment 400 is similar to the operating environment 200 described above with the following exceptions. In the operating environment 400, a recirculation line 700 is provided to allow fluid to be circulated out of and returned to the air chamber 30.

Such a recirculation loop may facilitate heat exchange with the fluid in a heat exchanger between the air chamber 30 and the nozzle 50 for maintaining the fluid at a desired temperature. In such embodiments, the heat exchanger may be located proximate to the nozzle 50. For example, the heat exchanger 45 may be located in a dispenser or under a counter upon which the dispenser is placed.

Referring to FIG. 6, the operating environment 400 is depicted in a dispensing or pouring state. In this state, fluid is pumped by the reversible pump 40B from the fluid source 10 into the air chamber 30 via check valves 714 and 15. Fluid is thereupon delivered by the reversible pump 40B through check valve 712 to an optional heat exchanger 45, through the valve 28, and to the nozzle 50 for dispensing during dispense of the fluids. Check valve 710 prevents fluid from flowing directly from the fluid source 10 to the nozzle 50, bypassing the air chamber 30. This is similar to the operating environment 200 described above.

In FIG. 7, the operating environment 400 is modified so that recirculation occurs. In this state, fluid is drawn by the reversible pump 40B out of the bottom of the air chamber 30, through the check valve 712 and the heat exchanger 45, if present, to a recirculation line 700. The valve 28 is closed during recirculation such that the fluid flows through the check valve 710 and back into the air chamber 30 through the valve 15. During recirculation, the check valve 714 prevents fluid from re-filling the fluid source 10. This recirculation can be conducted to keep the fluid at a desired temperature, and the recirculation can be conducted on a regular or intermittent basis. For example, recirculation may occur if a threshold amount of time has elapsed after a dispense operation, or a prior recirculation operation if there is no intervening dispense operation.

In FIG. 8, the operating environment 400 is modified so that the chamber 30 is vented. The reversible pump 40B is reversed so that fluid is pumped by the reversible pump 40B into the bottom of the air chamber 30 through the line 4A. The fluid is drawn from the fluid source 10 through the check valve 714 and the check valve 14 to the reversible pump 40B. The valve 28 is closed during the venting operation and the check valve 712 prevents fluid flow from the heat exchanger 45 to the air chamber 30. Moreover, the check valve 15 prevents air from recirculating from the air chamber 30 through the line 6 and back into the air chamber 30. The fluid from the reversible pump 40B displaces air in the air chamber 30, causing the unwanted air to be evacuated through the check valve 16 and line 2 to atmosphere, as is similarly described with reference to the operating environment 200.

Figure 9:
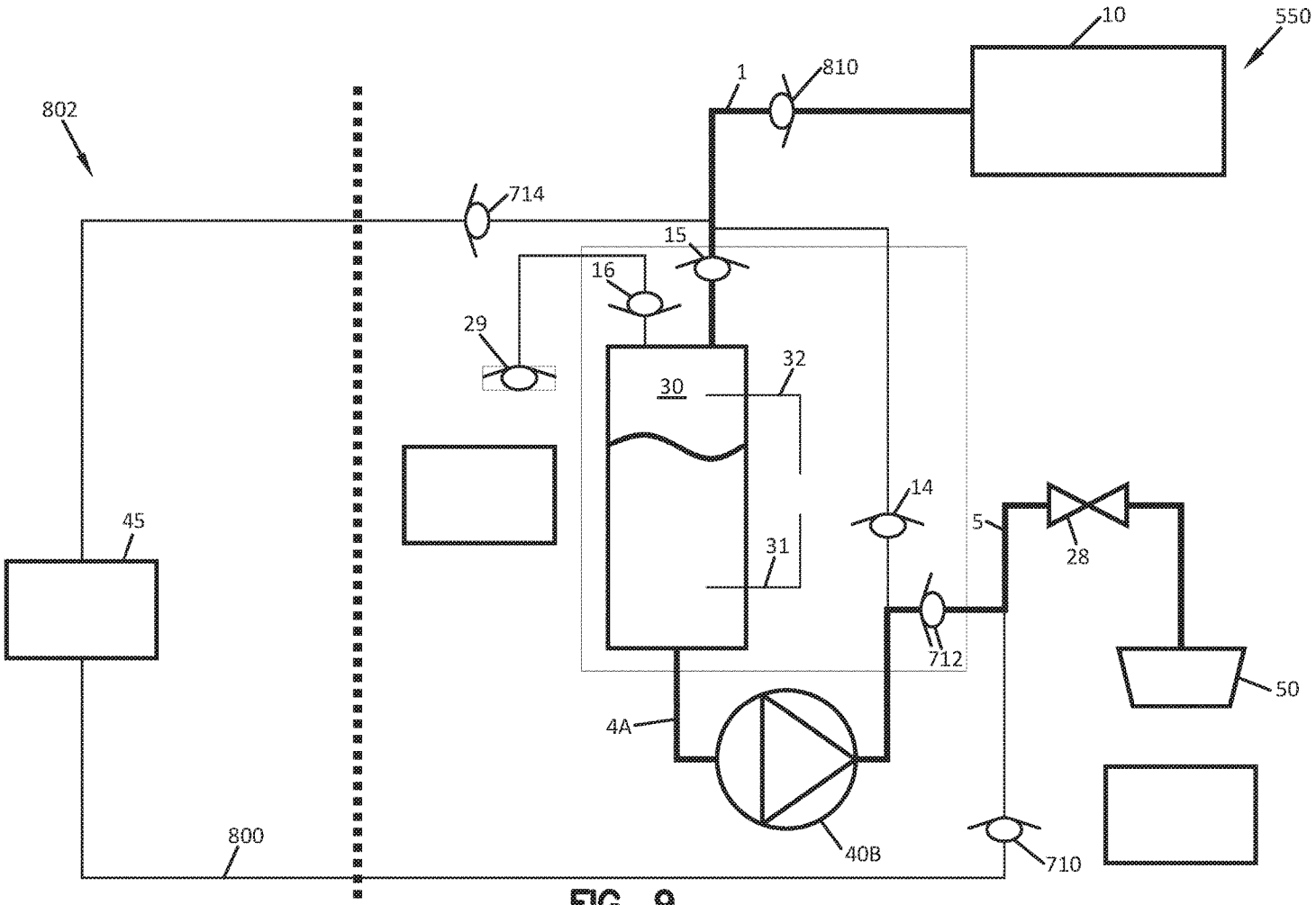
FIG. 9 is an alternative schematic view of a diagram of an exemplary operating environment for eliminating air within an air chamber as is described herein.
Figure 10:
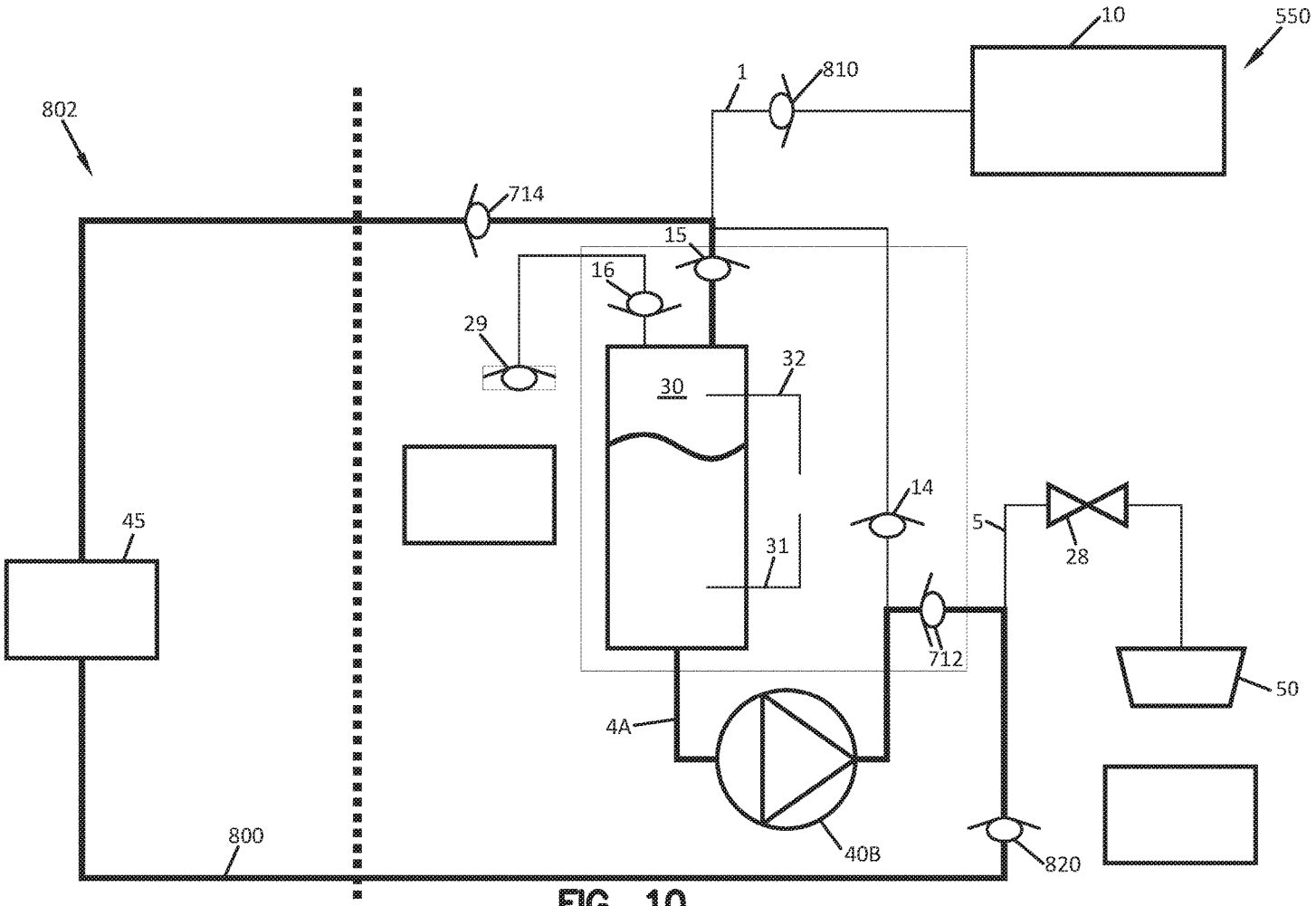
FIG. 10 is another view of the operating environment of FIG. 9.
Figure 11:
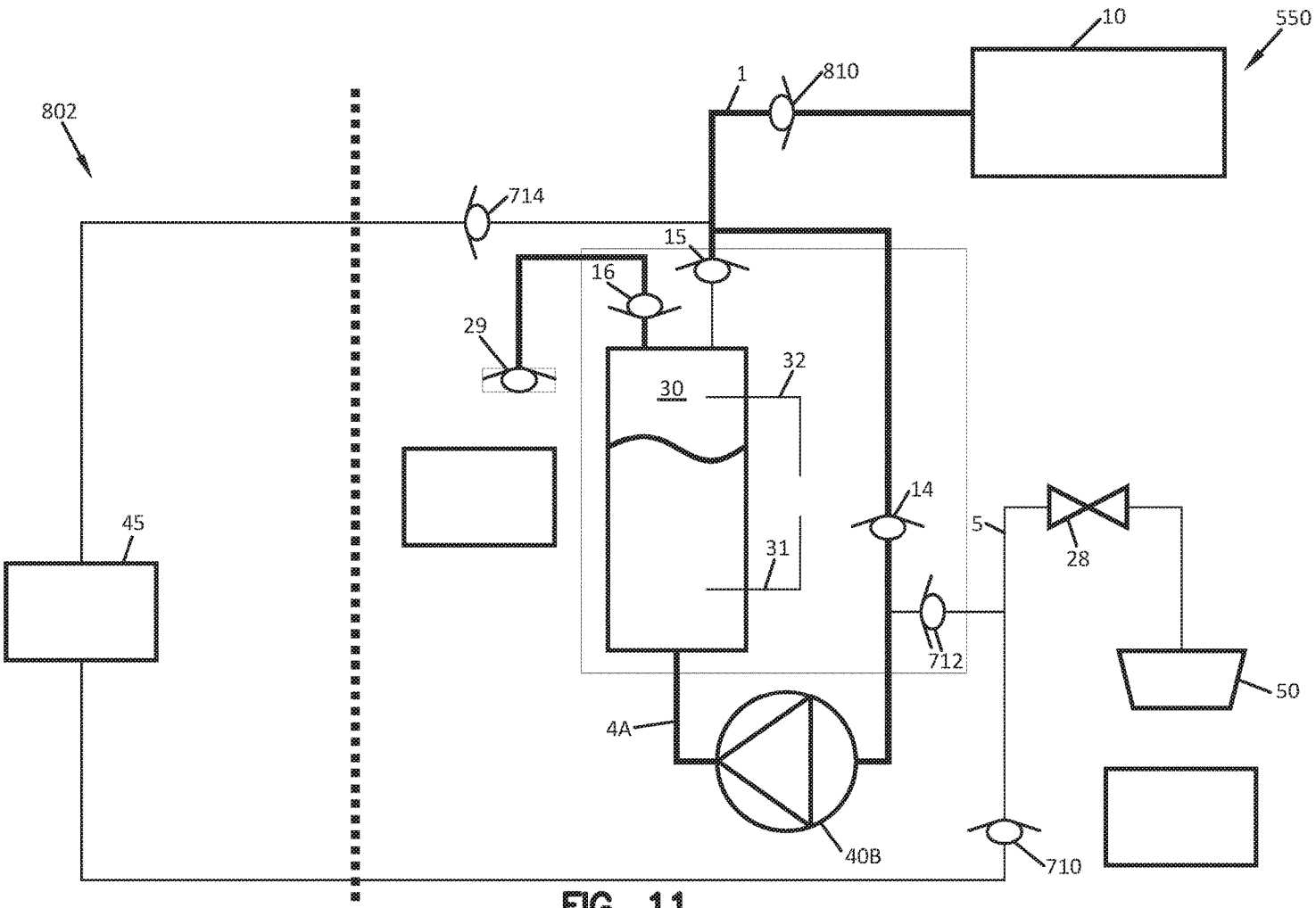
FIG. 11 is another view of the operating environment of FIG. 9.

Referring now to FIGS. 9-11, another operating environment 550 is shown. The operating environment 550 is similar to the operating environment 400 described above, except the heat exchanger 45 is provided in a recirculation line 800 located at a remote location 802. By providing the heat exchanger 45 in the recirculation line 800, the heat exchanger 45 may be located remote from the nozzle 50.

For example, the nozzle 50 may be in a dispenser on a counter and the heat exchanger 45 may be located under the counter or in a back room. The distance between the remote location 802 and other components of the operating environment 550 can vary from a few feet to ten, one hundred, or more feet.

As noted, this recirculation can be conducted to keep the fluid at a desired temperature. The recirculation can be conducted on a regular or intermittent basis. The recirculation line 800 may be an insulated line.

As shown in FIG. 9, the operating environment 550 is depicted in a dispensing or pouring state. In this state, fluid is pumped by the reversible pump 40B from the fluid source 10 into the air chamber 30 via check valves 810 and 15. Fluid is thereupon delivered by the reversible pump 40B through check valve 712 and valve 28 to the nozzle for dispensing during the dispense of the fluids. Check valve 710 prevents fluid from flowing directly from the fluid source 10 to the nozzle 50, bypassing the air chamber 30. This is similar to the operating environment 400 described above.

In FIG. 10, the operating environment 550 is modified so that recirculation occurs. In this state, fluid is drawn by the reversible pump 40B out of the bottom of the air chamber 30, through the check valves 712 and 820 and a recirculation line 800 to an optional heat exchanger 45, if present, located in a remote location 802. The valve 28 is closed during recirculation such that the fluid flows through the check valve 714 and back into the air chamber 30 through the valve 15. During recirculation, the check valve 810 prevents fluid from re-filling the fluid source 10.

In FIG. 11, the operating environment 550 is modified for venting of the air chamber 30. The reversible pump 40B is reversed so that fluid is pumped by the reversible pump 40B into the bottom of the air chamber 30 through the line 4A. The fluid is drawn from the fluid source 10 through the check valve 810 and the check valve 14 to the reversible pump 40B. The check valve 712 prevents fluid flow from the heat exchanger 45 to the air chamber 30. Moreover, the check valve 15 prevents air from recirculating back into the air chamber 30. The fluid from the reversible pump 40B displaces air in the air chamber 30, causing the unwanted air to be evacuated through the check valve 16 to atmosphere, as is similarly described with reference to the operating environment 400.

Figure 12:
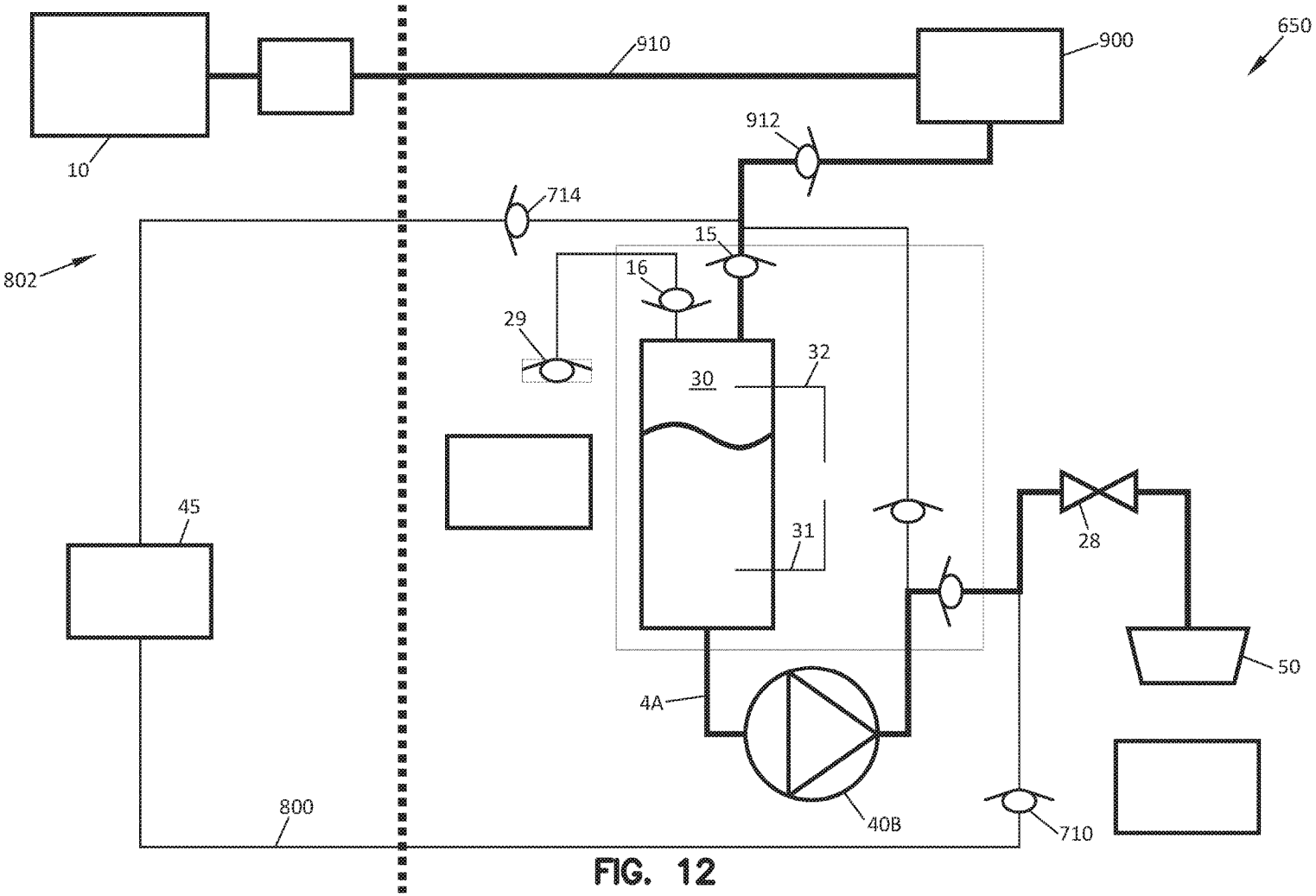
FIG. 12 is an alternative schematic view of a diagram of an exemplary operating environment for eliminating air within an air chamber as is described herein.

In FIG. 12, another operating environment 650 is depicted. This operating environment is similar to the operating environment 550 described above, except the fluid source 10 is also located remotely in the remote location 802. In this scenario, fluid from the fluid source 10 is delivered to the air chamber 30 through a line 910, a vacuum regulator 900, and a valve 912. The vacuum regulator 900 monitors the pressure at which the fluid is delivered from the fluid source 10.

Other configurations are possible. For example, other components of the environment, such as the air chamber, can also be relocated as needed.

While the present disclosure has been described in terms of particular preferred and alternative embodiments, it is not limited to those embodiments. Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

What is claimed is:

1. A method for removing air within an air chamber, comprising:

receiving a flow of a fluid at a first port of the air chamber from a fluid source in fluid communication with the air chamber;

dispensing the fluid at a second port of the air chamber; and reversing the flow to draw the fluid into the air chamber to purge air within any one of the air chamber and the fluid source through a third port by reversing a pump.

2. The method of claim 1, further comprising dispensing the fluid from the second port to a nozzle via a three-way valve.

3. The method of claim 1, wherein the fluid comprises a beverage forming ingredient.

4. The method of claim 1, wherein reversing the flow to draw the fluid to the air chamber comprises reversing the flow upon receiving an indication from one of: (i) a user at an interface; and (ii) a sensor within the air chamber.

5. The method claim 1, further comprising pumping the air to the atmosphere.

6. The method of claim 1, wherein reversing the flow to draw fluid into the air chamber further comprises:

allowing the pump to pump fluid into the second port.

7. The method of claim 1, wherein reversing the pump comprises:

changing a flow path from the pump to the air chamber; and reversing a flow direction of the pump to pump fluid into the first port or the second port.

8. A system, comprising:

an air chamber having a first port in fluid communication with a fluid source, wherein the first port is configured to receive a flow of a fluid by actuating a pump, a second port in fluid communication with the pump and configured to receive any one of the fluid and air from within the air chamber; and a third port in fluid communication with an atmosphere and configured to purge air within the air chamber by reversing the flow of the fluid;

a pump configured to pump the fluid from the fluid source to the first port; and a flow path between the fluid source and the air chamber, wherein the flow path is configured to be adjusted so that the pump pumps the fluid into the air chamber at the second port to purge the air within the air chamber.

9. The system of claim 8, further comprising the fluid source including the fluid having one or more beverage forming ingredients.

10. The system of claim 8, wherein the pump is configured to be reversed so that the pump pumps the fluid into the air chamber at the second port located at a lower portion of the air chamber to purge the air within the air chamber.

11. The system of claim 8, further comprising a recirculation path that allows fluid in the air chamber to be removed from the air chamber and be placed back into the air chamber.

12. The system of claim 11, wherein the recirculation path includes at least a portion of the path extending to a remote location.

13. A system, comprising:

an air chamber having a first port in fluid communication with a fluid source, wherein the first port is configured to receive a flow of a fluid by actuating a pump, a second port in fluid communication with the pump and configured to receive any one of the fluid and air from within the air chamber; and a third port in fluid communication with an atmosphere and configured to purge air within the air chamber when the flow of the fluid is reversed; and a pump configured to pump the fluid from the fluid source to the first port, wherein the pump is further configured to be reversed such that the pump pumps the fluid into the air chamber at the second port located at a lower portion of the air chamber to purge the air within the air chamber.

14. The system of claim 13, further comprising the fluid source including the fluid having one or more beverage forming ingredients.

15. The system of claim 13, further comprising a flow path between the fluid source and the air chamber, wherein the flow path is configured to be adjusted such that the pump pumps the fluid into the air chamber at the second port to purge the air within the air chamber.

16. The system of claim 13, wherein the pump is configured to be reversed upon receipt of an indication from one or more of:

a user at an interface;

a sensor within the air chamber.

17. The system of claim 13, further comprising one or more sensors positioned within the air chamber to provide an indication of a level of the fluid within the air chamber.

* * * * *